United States Patent [19]

Barch et al.

[11] 4,100,726

[45] Jul. 18, 1978

[54] METHOD FOR PRODUCING SLUBBY YARN

[75] Inventors: Herbert W. Barch, Natrona Heights; August G. Bohy, Lower Burrell, both of Pa.

[73] Assignee: PPG Industries, Inc., Pittsburgh, Pa.

[21] Appl. No.: 800,689

[22] Filed: May 26, 1977

Related U.S. Application Data

[60] Division of Ser. No. 749,198, Dec. 9, 1976, and a continuation-in-part of Ser. No. 639,723, Dec. 11, 1975, abandoned, which is a continuation-in-part of Ser. No. 582,493, May 30, 1975, abandoned.

[51] Int. Cl.[2] ..... D02G 3/34

[52] U.S. Cl. ..... 57/157 F; 28/257; 57/140 J

[58] Field of Search ..... 57/34 B, 140 J, 140 G, 57/157 F; 28/254, 257, 271

[56] References Cited

U.S. PATENT DOCUMENTS

| | | | |
|---|---|---|---|
| 2,313,630 | 3/1943 | Docherty | 65/6 |
| 2,435,891 | 2/1948 | Lodge | 264/282 |
| 2,614,773 | 10/1952 | Ammerall | 242/147 M |
| 2,909,827 | 10/1959 | Waugh | 19/156.3 |
| 2,990,671 | 7/1961 | Bunting, Jr. et al. | 57/34 |
| 3,060,674 | 10/1962 | Slayter | 57/140 G X |
| 3,079,745 | 3/1963 | Breen et al. | 57/343 |
| 3,110,151 | 11/1963 | Bunting, Jr. et al. | 57/157 |
| 3,127,729 | 4/1964 | Head | 57/34 B |
| 3,262,177 | 7/1966 | Cobb et al. | 28/252 |
| 3,286,321 | 4/1960 | Fletcher et al. | 28/274 |
| 3,368,355 | 2/1968 | Howath | 57/34 |
| 3,388,444 | 6/1968 | Beunon | 28/72 |
| 3,410,077 | 11/1968 | Marzocehi et al. | 57/144 |
| 3,417,445 | 12/1968 | Gemenhardt et al. | 57/140 J |
| 3,425,108 | 2/1969 | Ceruhi et al. | 57/34 B X |
| 3,487,619 | 1/1970 | Field, Jr. | 57/51 |
| 3,496,714 | 2/1970 | Schroeder | 57/91 X |
| 3,538,701 | 11/1970 | Cannon et al. | 57/157 F X |
| 3,783,596 | 1/1974 | Waldkirch | 57/157 F |
| 3,832,840 | 9/1974 | Lauglois et al. | 57/140 J |
| 3,835,511 | 9/1974 | Schrader et al. | 57/34 B X |
| 3,861,133 | 1/1975 | Frankfort et al. | 57/140 R |
| 3,955,952 | 5/1976 | Drummond | 57/140 G X |

*Primary Examiner*—Richard C. Queisser
*Assistant Examiner*—Charles Gorenstein
*Attorney, Agent, or Firm*—Alan T. McDonald; John E. Curley

[57] ABSTRACT

A process is disclosed for preparing slubby strands in which a textile strand is passed either over a surface or through a slubbing tool. The surface, if employed, may include a plurality of fluid passages positioned therein. As the strand passes over the surface or through the slubbing tool, high pressure fluid is introduced onto the surface of and through the strand. The high pressure fluid passes through the strand. This passage of fluid through the strand causes the strand to twist and bulk along its length to form a slub which is rapidly removed from the working surface of the slubbing surface or tool as a consolidated slub positioned on the strand. When a surface is employed, the surface may be a moving surface and when the surface includes a plurality of fluid passages, the passages may be vented at a point below the surface. Various apparatus for carrying out the novel method are disclosed as is the novel strand produced thereby. The process is described with particular reference to producing strands of glass fibers.

11 Claims, 18 Drawing Figures

FIG. 1
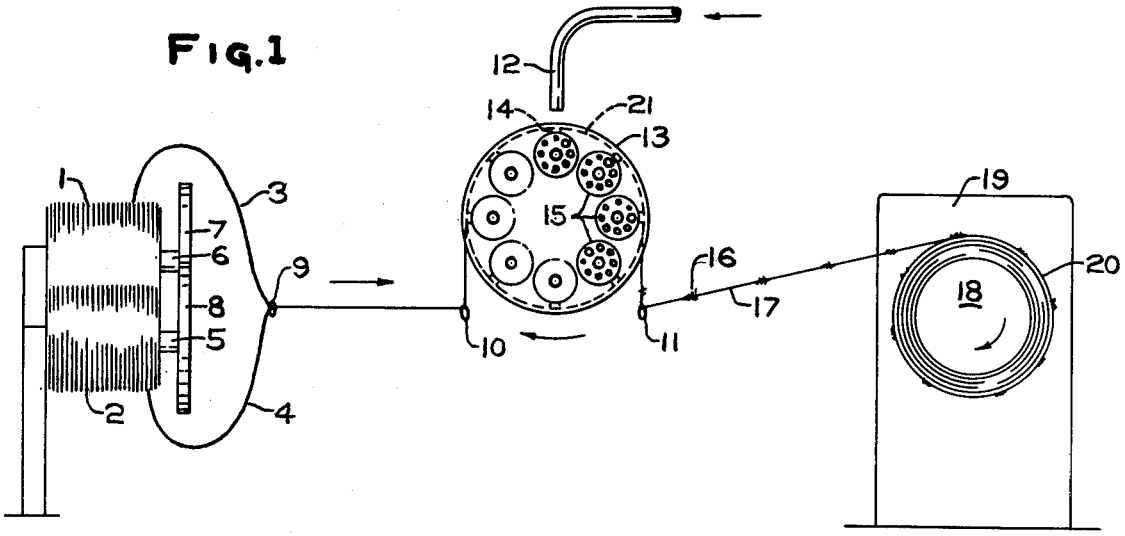
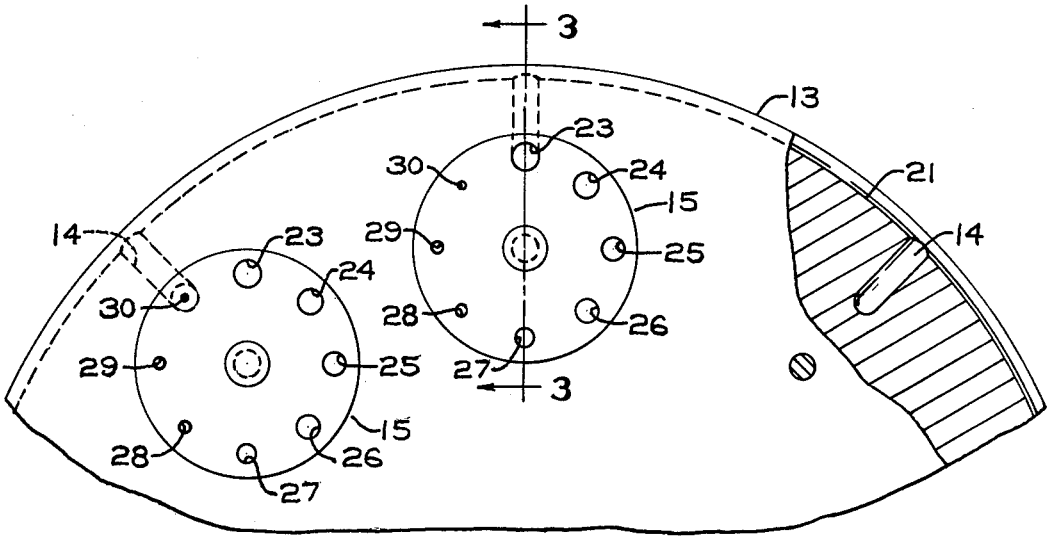
FIG. 2
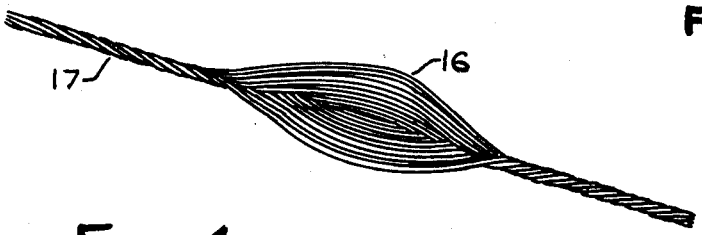
FIG. 4
FIG. 3
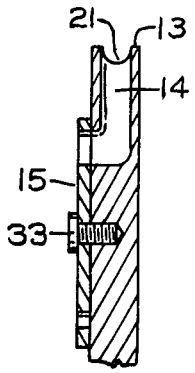

FIG.5
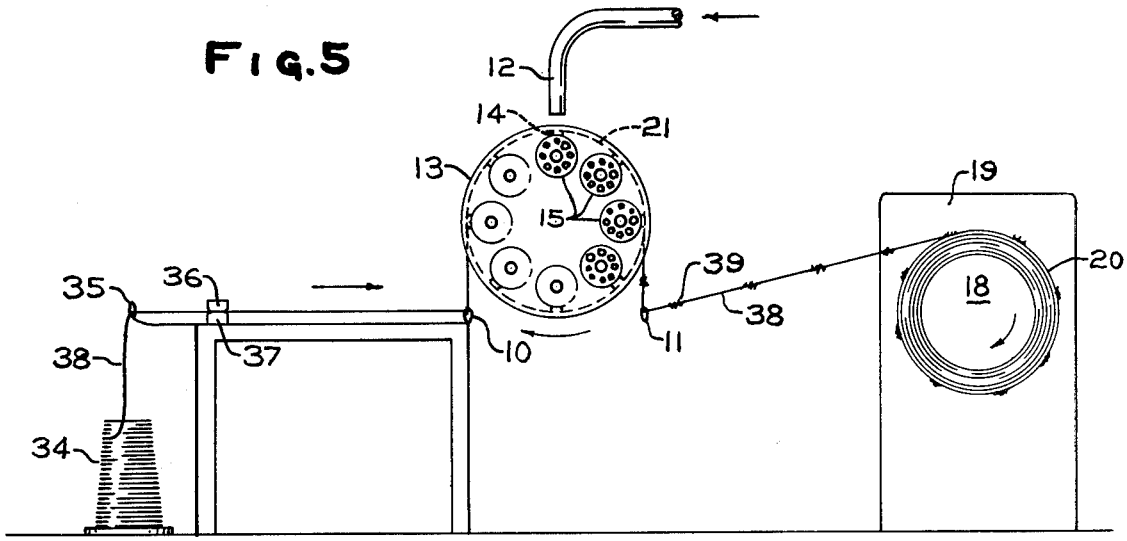
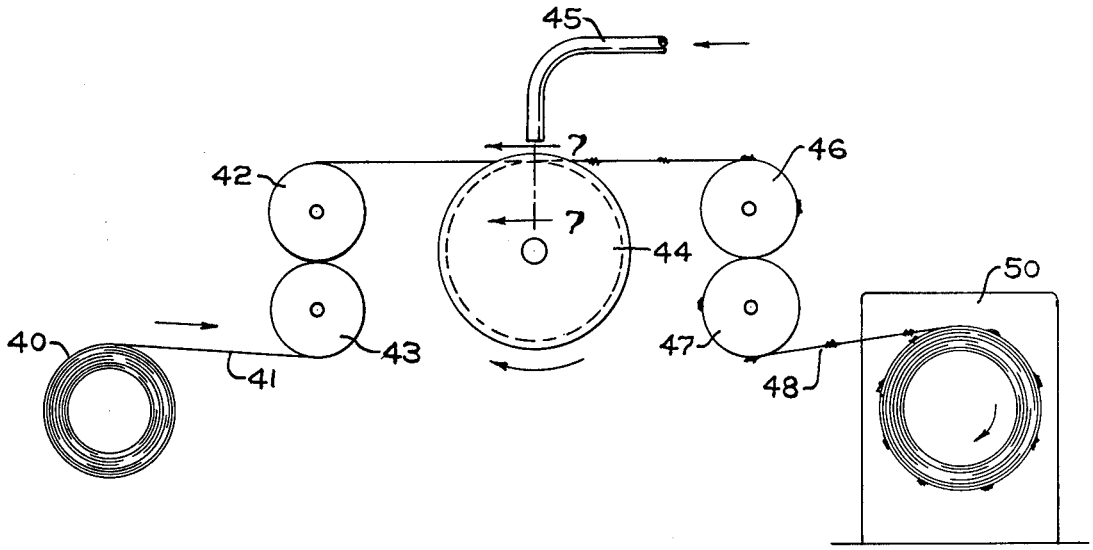
FIG.6
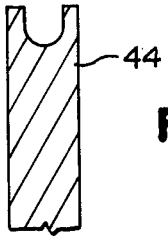
FIG.7

METHOD FOR PRODUCING SLUBBY YARN

CROSS-REFERENCE TO RELATED APPLICATIONS

This application is a divisional of U.S. Ser. No. 749,198 filed Dec. 9, 1976, and a continuation-in-part of U.S. Ser. No. 639,723, filed Dec. 11, 1975 abandoned, which is a continuation-in-part of U.S. Ser. No. 582,493, filed May 30, 1975, now abandoned.

BACKGROUND OF THE INVENTION

Novelty yarns or strands are produced by a variety of processes in the textile field and find utility for many specific textile purposes, for example, in the manufacture of draperies, industrial cloths used as reinforcement for resin articles and the like. Many processes have been designed, especially in processing glass fiber strands, to produce decorative effects on textile strands to render them useful in providing bulk for cloth to be woven for decorative purposes as well as cloth woven for industrial purposes such as resin reinforcement.

Thus, in U.S. Pat. No. 3,388,444 a process is described in which glass fiber strands are passed through a texturizing jet at various rates of speed and air under pressure is introduced into the jet to entangle the yarns passing therethrough to produce a bulking effect on the yarn issuing from the jet. In another process, bulky textile yarn is produced by providing a core and effect yarn, each of which travels at different speeds as they are passed through an air jet device to filamentize the fibers of the faster traveling strands and entangle them within the core yarn. A typical process of this type is illustrated in U.S. Pat. No. 3,262,177. Another process for producing a bulky yarn having intermittent bulking along its length is shown in U.S. Pat. No. 3,410,077.

While all of the above processes are useful in producing novel textile strands, a need still exists in the art for a process which will produce efficiently a slubby textile strand in which slubs of good integrity are present. Minimized filament damage caused by breaking filaments during the processing of a strand is also a desired goal in producing slubby strands. Filament damage to strands using the procedures of the prior art often reduces strand strength below an acceptable value. Further, in producing textile strands having slubs thereon, it is a desired goal to produce slubs randomly so that the cloth woven therefrom does not develop a fixed pattern.

THE PRESENT INVENTION

In accordance with the present invention, methods of producing a textile strand having intermittent or random slubs produced along the length thereof are provided which permit the formation of these slubs at high speeds. The processes also provide slubs which have extremely good integrity in that, once provided on the textile strand, they cannot easily be pulled out of the strand by pulling the strand at either end of the slub. This feature is important in that the strands provided in accordance with the instant invention can be woven and otherwise physically handled in various textile finishing operations when they are utilized to produce cloth without losing slub integrity. When glass fibers are used as the textile strand, it has been found that the processes can produce a slubby strand having very few filament breaks therein. In addition, slubs of varying size can be produced on the same strand and in random locations. By varying yarn tension, it is also possible using the processes and apparatus herein described to produce texturized yarns. Novel apparatus for producing slubs along a textile strand are also provided which are simple in construction and permit considerable versatility in the production of slubs as to their size and their location along a given length of a continuous strand.

The strand produced by the instant process is characteristically twisted on either end of the slubs produced in accordance with the practice of the instant invention and this greatly assists in locking the slubs in place so that they cannot be inadvertently removed by subsequent tension placed on either end of a slub during processing of the strands on which they are positioned. It has also been observed that strands produced in accordance with this invention, especially those produced from glass fiber strands, have little or no fiber breaks therein, thus producing a slubby or textured glass fiber strand having extremely high tensile strength.

Thus, in accordance with the present invention, a consolidated textile strand containing a multiplicity of fibers therein is passed over a surface or through a slubbing tool having an interior surface. If a surface is employed, the surface may include a plurality of fluid passages over which the strand passes during its travel to a collecting zone. High pressure fluid, such as air, is introduced onto the surface of the strand. As the high pressure fluid passes through the strand, the fluid twists and bulks the strand along its length. If a surface has been provided with fluid passages below the surface, part of the fluid may be exhausted through those fluid passages after passing through the strand. The bulked strand is rapidly removed from the surface or the slubbing tool thereby producing a slub at various points on the strand and the strand with the slubs thereon is transported to a collection zone where it is wound or collected in any suitable manner for ultimate distribution to the customer. By varying the rate of exhaust in one or more fluid passages, varying the speed of travel of the strand over the surface or through the slubbing tool, varying the pressure of the high pressure fluid, or varying the total available air space in the slubbing tool, variations in slub size for a given strand can be readily realized.

For a more complete understanding of the present invention, reference is made to the accompanying drawings in which:

FIG. 1 shows a schematic diagram of the operation of one embodiment of the instant invention using conventional forming packages as the feed and wherein two glass strands are being consolidated into a single strand during their passage over the strand treating surface;

FIG. 2 is an enlarged view of the wheel 13 of FIG. 1, partially broken away, to show the orientation of the fluid passages and the exhaust holes therein;

FIG. 3 is a cross-section of a fluid passage located on the surface of the wheel 15 of FIG. 2;

FIG. 4 is an artist's rendition of a photograph of a glass strand produced in accordance with the embodiment of FIG. 1 of the instant invention;

FIG. 5 shows a schematic diagram of the embodiment of FIG. 1 of the instant invention used to produce a slubby strand from a single strand removed from a bobbin;

FIG. 6 shows a schematic diagram of another embodiment of the invention wherein a surface having no holes therein is employed to produce a slubbed yarn and a low tension loop is provided between two pairs of nip rollers;

FIG. 7 is a cross-sectional view of the wheel employed as the working surface in the embodiment of FIG. 6;

In the production of slubs on textile strands in accordance with the practice of the instant invention, any conventional textile strand can be employed, provided it is capable of being opened up by the passage therethrough of high pressure fluid, such as air, steam, water, nitrogen, carbon dioxide or the like. Preferably, gaseous fluids are employed and most preferably air is employed as the gaseous fluid. The invention has particular utility in the production of slubs on consolidated strands containing multiplicities of glass fibers and can produce these slubs with little or no breakage of the fibers during the formation thereof. This is an important consideration in the preparation of glass strands because glass filaments, in general, have little or no elasticity and often the prior art processes involving the bulking of glass strands produce strands which may have many broken filaments therein.

For convenience in the discussion of the instant process, the process will be described with reference to the production of glass strands having slubs placed along their length, although it will be understood that the invention is applicable to the production of slubs on any synthetic or natural textile strand containing a multiplicity of filaments in the strand.

In the production of slubby glass fiber textile strands, the source of the strand can be varied. Thus, for example, by recourse to special processing techniques, glass fiber strands can be processed in accordance with this invention using as the strand source forming packages, i.e., wound strand on a tube produced by winding as the glass fiber strand was prepared from a molten source of glass. Forming packages can be employed either wet or dry. The fiber glass strands may also be processed directly from bobbins which are normally produced by placing a forming package on a conventional twist frame and twisting the strand to any desired twist value as it is removed from the forming packages and wound on the bobbin. In addition, the strands may be slubbed directly as they are formed from a bushing.

Figure 8:
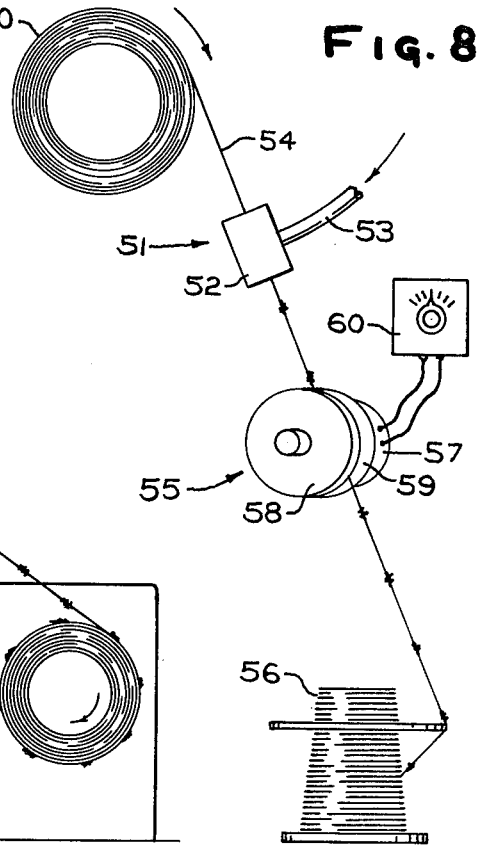
FIG. 8 is a schematic diagram of still another embodiment of the instant invention in which a magnetic tension device is used to create a low tension loop in the yarn, a slubbing tool is employed to form the slubs in the yarn, and the finished product is wound on a standard twist frame.

It is also contemplated, utilizing the instant invention, to apply the slubs to the glass fiber strand on a conventional textile twist frame by feeding the strand contained on forming packages through the slubbing operation of the instant invention prior to collecting them on the bobbins of the twist frame. While in the specific embodiment of the invention shown in FIG. 1 two glass fiber strands are utilized to produce the final strand product, it will be readily understood that more than two strands can be fed to the system and slubbed in the same manner as the two strands depicted in FIG. 1 to produce a final slubbed strand. Obviously, it is also contemplated that a single strand feed be employed to produce yarns in accordance with the invention. Thus, while FIGS. 5, 6 and 8 show a single end strand being slubbed from either a bobbin or a forming package source, it will be understood that multiple end products may be produced by combining several strands prior to subjecting them to slub treatment in these embodiments.

For convenience, the invention will now be described with reference to the instant drawings and utilizing as the exemplary textile strand strands composed of a multiplicity of glass fiber filaments.

Turning to FIG. 1, there is shown therein, positioned in a side-by-side relationship, two glass strand containing forming packages 1 and 2. Each of these forming packages 1 and 2 have inserted therein a central pin 6 and 5, respectively, which contains on its outer surface a circular ring member 7 and 8, respectively. These ring members 7 and 8 are provided so that the strand can be ballooned out over the forming package for easy removal. The strands 3 and 4, removed from the packages 1 and 2, respectively, are consolidated into a single strand in an eyelet 9 and passed under an eyelet 10 for feeding to a rotating wheel 13. Located on the surface 21 formed on the face of the wheel 13 are a plurality of gas passages 14 which are drilled into the body of the wheel member 13. These passages 14 are better shown in FIG. 3. The surface 21 may be a curved, generally U-shaped, surface, as shown, or may be a relatively flat surface. Gas passages 14 communicate with the atmosphere surrounding the wheel member 13 through a plurality of holes contained on a circular plate member 15 affixed to the surface of the wheel member 13. The holes, 23, 24, 25, 26, 27, 28, 29 and 30 shown in FIG. 2 on the plate member 15 are exit holes of varying diameter which are placed over the opening of the gas passages 14 and vent the passage 14 to the atmosphere. By adjusting the position of circular plate 15, any of the holes 23 through 30 can be aligned with the passage 14. If desired, the solid plate 15 can be placed over any of the passages to thus close it to the atmosphere. Thus, as will be readily appreciated, the venting of the gas passages 14 to the atmosphere can be readily controlled. Adjustment of the venting provides a varying gas flow through the passage 14.

As shown in FIG. 4, the invention produces a slub 16 on strand 17. The slub 16 is characterized by being interposed between counterdirectionally twisted strand on either side thereof thus rendering the slub physically stable during later processing. It is also characteristic of the slub 16 produced in accordance with this invention that very few breaks occur on the strands. This is particularly useful in the production of fiber glass strands, since, due to their lack of elasticity, most texturizing systems utilized in the production of fiber glass strands result in numerous breaks of filaments and a consequent significant reduction in the tensile strength of the strand produced.

In an alternative method of producing strand containing slubs in accordance with the instant invention and with particular reference to FIG. 5, a single end 38 is utilized to produce fiber glass strand having intermittent slubs 39 produced along the length thereof. In this embodiment, the single strand 38 is removed from a bobbin 34, passed through eyelet 35 and through tension control members 36 and 37. The tension control members are typically polished plates 36 and 37 through which the strand 38 is passed. The tension is normally controlled by varying the weight of the top plate 36 or by placing more than one plate 36 over the plate 37. The strand 38 is then passed through eyelet 10 and over the wheel member 13 which is identical to the wheel of FIGS. 1, 2 and 3. Appropriate adjustments are made in the wheel member 13 to place over the apertures of the gas passages 14 located in the sidewall of the wheel 13 the appropriate hole sizes. This is accomplished by rotating device 15 to line up the appropriate hole therein with the exit of passage 14. In this manner, slubs are produced from a single strand 38 in the same manner, as they are produced on the double strand shown in FIG. 1 and again the strand produced characteristically is counterdirectionally twisted on either end of the slub 39 thus produced.

In FIG. 6, a forming package 40 is illustrated comprising glass strand 41. This strand 41 is passed around a pair of nip rollers 42 and 43 and onto a surface 44 formed on the face of a wheel similar to the shape of the surfaces 21 in FIGS. 1 and 5. However, as better seen in FIG, 7, there are no holes for venting of fluid on surface 44. While the surface 44 is illustrated as on a wheel, any surface, either curved or flat, which would provide a base for holding the strand 41 while fluid is impinged thereon would suffice. A jet 45 provides the high pressure fluid for conducting the twisting and slubbing process. The slubbed fiber 48 produced proceeds between nip rollers 46 and 47 to a winding mechanism 49 which may be a simple winder, or, for example, a twist frame. In this embodiment, the nip rollers 42 and 43 may be driven at a linear rate of speed slightly in excess of nip rollers 46 and 47, for example, 3 to 10 percent greater, so that a low tension loop (approximately zero tension) is formed between the rollers where the slubbing takes place.

FIG. 8 illustrates another embodiment of the instant invention wherein a slubbing tool 51 including a hollow body 52 having an interior surface and a high pressure fluid jet 53 is employed as the slubbing mechanism, replacing the surfaces of the previous embodiments. The interior surface of the jet 53 may take any of numerous shapes. The tool 51 is illustrated as having a round interior. However, elliptical, square, rectangular, and other shaped interiors may be employed. The entire system is carried on a typical twist frame for fabric yarns. Strand 54 from strand source 50 is introduced at the entrance of the hollow body 52 and subjected to a slubbing treatment by impinging high pressure fluid through the fibers making up the strand 54 with high pressure fluid, typically air, issuing from jet 53. The jet 53 twists and slubs the fiber while it is within the slubbing tool. The thus twisted and slubbed strand is removed from the slubbing tool 51 by a magnetic tensioning device 55. The device 55 comprises two metal tension plates 58 and 59 and electromagnet 57. The electromagnet 57 is controlled by controller 60. The electromagnet 57 draws the tension plates 58 and 59 tightly together, thus increasing the tension in the strand between the device 55 and the bobbin 56, resulting in overfeed and a low tension portion between driven forming package 50 and device 55. The strand is then wound on the bobbin 56.

Figure 9:
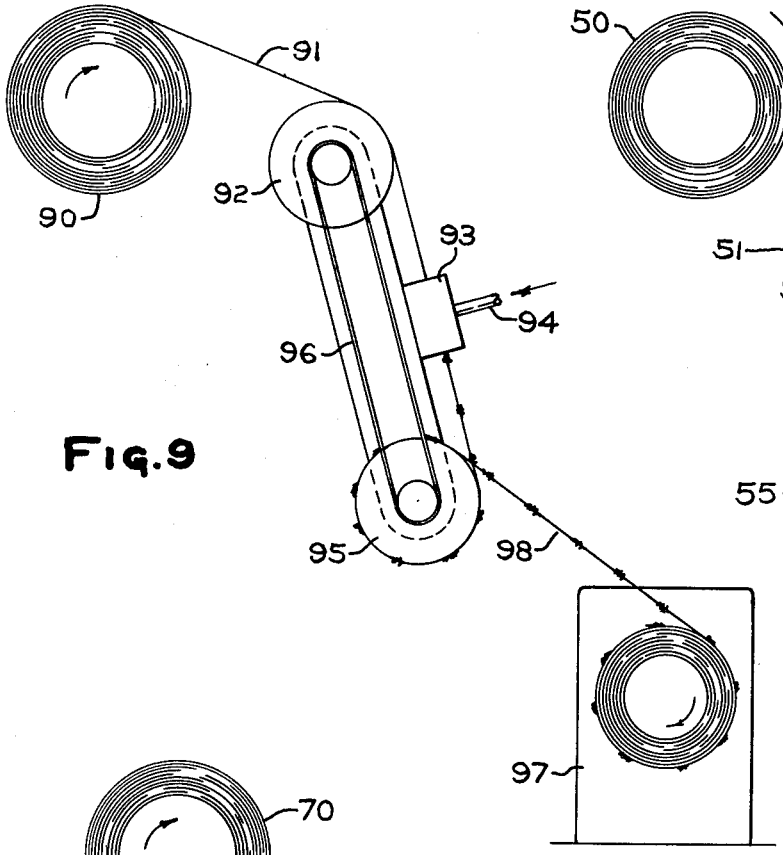
FIG. 9 illustrates another method for forming a low tension loop of yarn for feed to the slubbing process, wherein low inertia capstans are driven by a single motor at different speeds through a belt connector.

FIG. 9 illustrates another mechanism for producing a low tension loop in a textile strand. Strand 91 coming from forming package 90 is looped around a low inertia capstan 92. The strand is then passed through a slubbing tool 93, which may be the tool 51 in FIG. 8, and around a second capstan 95 to a forming package 97. The two capstans 92 and 95 are connected by a belt 96. The first capstan 92 is driven at a linear rate of speed slightly in excess of capstan 95, for example 3 to 10 percent greater, thus forming a loop of strand having approximately zero tension between the two capstans 92 and 95. The slubbing operation takes place within the low tension loop as in FIG. 8. The slubbed strand 98 is collected on winder 97.

Figure 10:
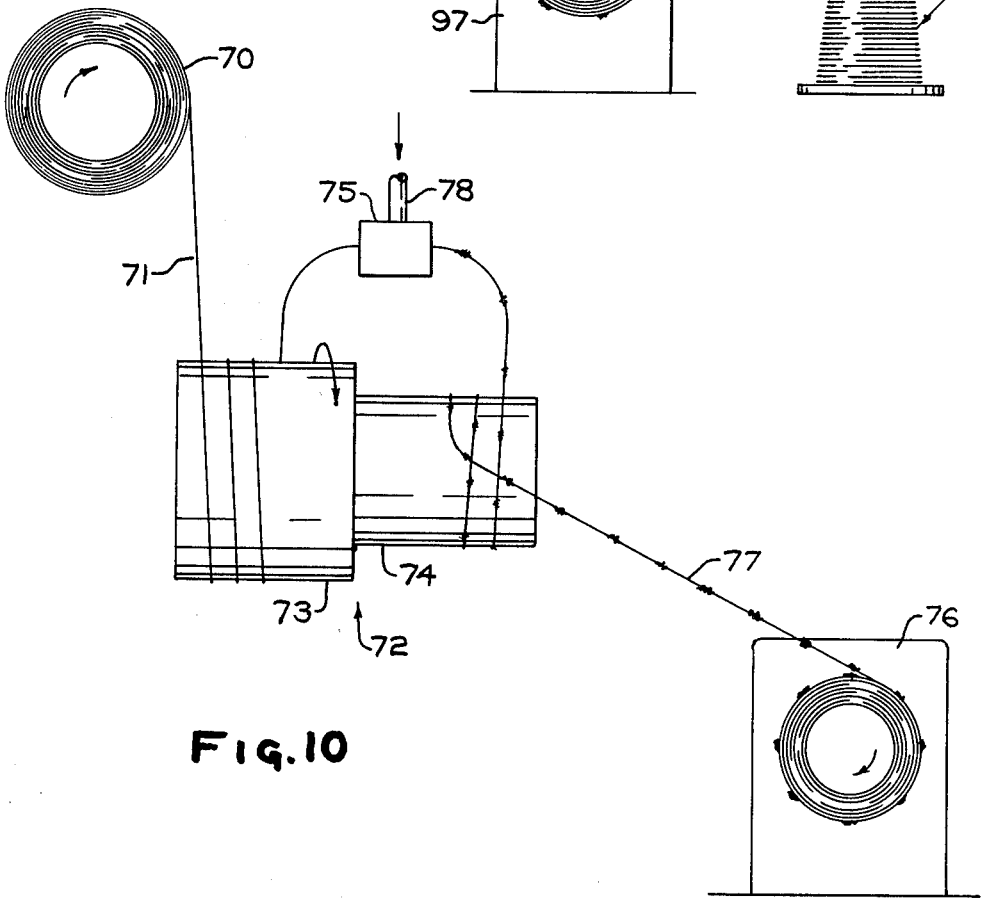
FIG. 10 illustrates a step godet for forming the low tension loop in the yarn fed to the slubbing systems described.

In FIG. 10 another means for forming a low tension loop is illustrated. In this FIG. the strand 71 coming from a forming package 70 is looped around the large step 73 of a two-step godet 72, through a slubbing tool 75, looped around the smaller step 74 of the step godet 72 and to a suitable winder 76. As the step godet 72 is rotated at a constant angular velocity, the step 73, having a larger diameter, will have a greater linear velocity than smaller step 74. This velocity, of course, can be controlled by varying the diameters of the two steps 73 and 74. It has been found desirable to keep the linear rate of speed of step 73 about 3 to 10 percent greater than step 74. By doing so, a low tension loop is formed in the strand between the two steps 73 and 74 and within this low tension loop is located the slubbing tool 75. Thus the slubbing process is again completed within the low tension loop.

Figure 11:
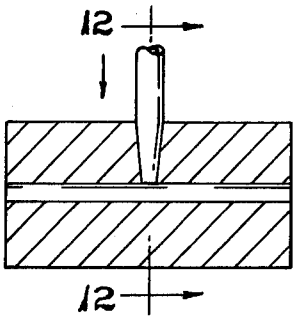
FIG. 11 is an illustration of a suitable slubbing tool for use in the instant invention showing the location and configuration of the fluid jet within the tool.
Figure 12:
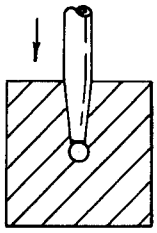
FIG. 12 is a sectional view along line 12—12 of FIG. 11 illustrating the relation between the interior surface and the fluid jet.

FIG. 11 illustrates in more detail the slubbing tool 51 shown in the embodiment of FIG. 8. The tool comprises a hollow body 52 having an interior surface and having a fluid jet 53 embedded therein and approximately normal to the interior surface of the hollow body 52. The shape of the interior of the tool may take any desired form, such as round, elliptical square, etc. The exact location of the nozzle with respect to the hollow body 52 is seen in more detail in FIG. 12. The vertical distance between the nozzle 54 and the bottom of the surface of the hollow body 52 is adjustable to give varied effects to the slubs produced in the yarn undergoing treatment in this tool. The fiber strand to be treated is pulled through this tool and is subjected to the high pressure fluid at nozzle 54 thus resulting in the production of the slubbed fiber.

Figure 13:
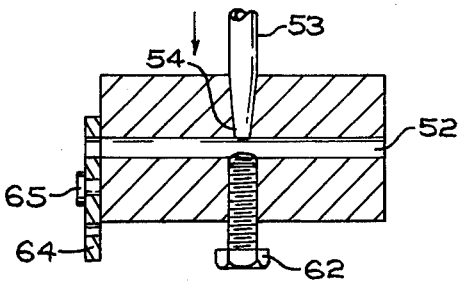
FIG. 13 is a sectional view of another suitable slubbing tool for use in the instant invention illustrating the means employed for varying the entrance diameter to the slubbing tool and the means employed to vary the total fluid volume within the tube.
Figure 14:
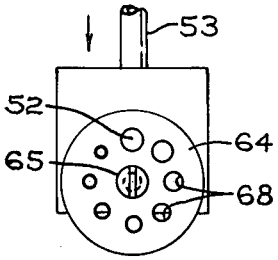
FIG. 14 illustrates a wheel which may be used to vary the diameter of the entrance to the slubbing tool of FIG. 13.

FIG. 13 illustrates another slubbing tool useful in practicing the instant invention. In this Figure, the hollow body 52, the air jet 53 and the nozzle 54 are identical to those shown in FIG. 11. In addition, there is employed an air chamber 61 having a device, such as a screw or baffle 62, which may increase or decrease the total volumetric area of the fluid space within the hollow body 52 by adjusting the positioning of the screw or baffle 62. In addition, there is illustrated a wheel 64 similar to wheels 15 in FIGS. 1 and 5, which is employed at the entrance of the hollow body 52. This wheel varies the diameter of the entrance to the body 52. It has been found that when decreasing the size of the entrance, the flow pattern of the fluid within the hollow body tends to aid in pulling the strand through the hollow body 52. This, of course, will change the characteristic of the thus formed slub.

Figure 15:
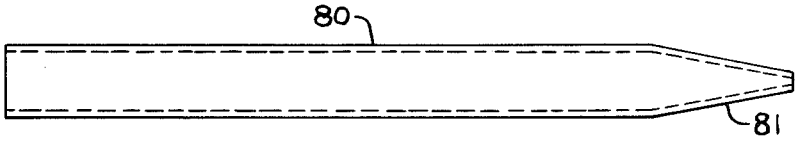
FIG. 15 illustrates a suitable fluid jet which may be employed in the instant invention.
Figure 16:
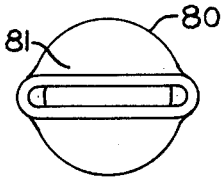
FIGS. 16 through 18 illustrate suitable nozzle configurations for the fluid jet of FIG. 15.
Figure 17:
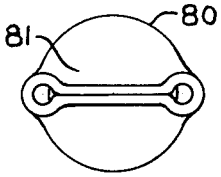
Figure 18:
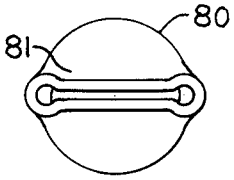

FIG. 15 illustrates a typical high velocity nozzle for supplying fluid under pressure to the working surfaces of any of the slubbing apparatus of the present invention. Thus, this nozzle may be located above the surfaces of FIGS. 1, 5 and 6, or inside the slubbing tool of FIGS. 8, 9 and 10 and may be varied in height above the surfaces. The nozzle comprises a hollow tube 80 having an end portion 81. The end portion 81 has an opening or openings therein. This opening can take varied shapes. Particularly desirable is the slot of FIG. 16 which may be, for example, of a length of about 0.094 inch (2.38 millimeters) and a width of 0.005 inch (0.127 millimeter), the two spaced small circular holes at each edge of the end as shown in FIG. 17, said holes having a diameter, for example, of about 0.042 inch (1.067 millimeter), spaced about 0.094 inch (2.38 millimeters) from each other, and the combinaion of the slot and the holes, giving a "dog bone" shape, the slot having a length of about 0.094 inch (2.38 millimeters), a width of about 0.005 inch (0.127 millimeter) and the circular holes having diameters of about 0.042 inch (1.067 millimeter), as can be seen in FIG. 18.

The exact mechanism which results in the formation of the slubs in the yarn treated in accordance with this invention is not completely understood. Several theories have been advanced to explain formation of slubs on the strand.

The first theory is that, as the strands are passed over the surface and under the air nozzle, or through the slubbing tool and high pressure air is applied to them, the entire strand is bulked by expanding the fibers which constitute the strand. At the same time, due to the low tension in the strand and the turbulent air flow around the strand, the strand is twisted along its length. The slubs form at the areas along the strand length where the direction of the twist changes. This forms a bulked, twisted strand followed by an area of untwisted, bulked strand, followed by a reverse twisted, bulked strand.

Another theory is that the air stream twists the strand along its length and does not bulk the entire strand. Only at the locations along the strand where the direction of twist is about to reverse is there an area of untwisted strand. At these points the air bulks the strand forming the slubs between areas of opposite direction twist.

A third theory states that the slubbing effect produced by the practice of the present invention is the result of a "double vortex" effect. Thus, whether the surface on the face of a wheel, or the like or the surface inside a slubbing tool is employed, the fluid passing through the nozzle 80 is directed into a pair of countercurrent streams rotating generally as circles around approximately one-half of the surface. As the strand is passed through the tool or across the surface, it is alternately caught within one of the countercurrent fluid streams which will twist the strand in the direction of that stream. When the strand is, in turn, caught up by the opposing fluid stream, the strand is twisted in the opposite direction. Between these counterdirectional twists are null points where there is no twist in the strand. At these points, the fluid within the tool or being directed onto the surface will bulk the yarn, thus producing slubs which, due to the counterdirectional twists on either side will not readily pull out.

Regardless of the theory used to explain the phenomenon occurring using the method described herein, it remains clear that, using the process and apparatus of the instant invention, the final resulting strand consists of highly bulked slubs having twisted strand surrounding the slubs, the twist on each side of a given slub being in opposing direction. The thus produced strand has slubs which cannot easily be pulled out and is a highly desirable commercial product.

Since it is often the desire of the ultimate user of this product to have placed on any textile strand slubs at random positions or slubs of varying sizes at random positions to prevent pattern buildup in a finished cloth produced from such material, wheel speed 13 in FIG. 1 may be varied by utilizing a variable speed motor and running the speed up and down to provide slubs at different lengths along a given length of strand undergoing treatment. Similarly, gas passages 14 may be closed off or adjusted in hole size so that the slubs produced along a given length of strand are different in size and form a random pattern of varying slub size along a given length of the strand. It is also within the purview of this invention to provide intermittent fluid flow in the high pressure fluid line to thereby permit intermittent contact of the high pressure fluid with the strand undergoing treatment. Other means for varying the slub treatment include varying the winder speed, the fluid pressure to the nozzle, the air space within the slubbing tool, the height of the nozzle above the bottom of the surface of either the wheel or the tool, the shape of the nozzle, the entrance size to the slubbing tool, and the tension of the strand as it passes through the slubbing tool or over a surface.

To more clearly understand the invention, reference is made to the following examples which have typically produced a slubby strand in accordance with the practice of the instant invention.

EXAMPLE I

In this example the equipment utilized was that generally depicted in FIG. 5 and the runs will be described with reference to that figure.

A series of runs were made with single end yarns 38 supplied from a bobbin 34. The yarns 38 were drawn by the winder 18 from the bobbin 34 and across the wheel 13 prior to being wound into package 20. The speed of travel of the yarn across the wheel 13 was varied from 244 feet per minute to 2,250 feet per minute (74.4 to 658.8 meters per minute). The air pressure during the run was 30 to 40 pounds per square inch gauge (206,842 to 275,790 pascal). The air jet had a nozzle having an opening of the "dog bone" pattern illustrated in FIG. 18. The wheel 13 was provided with cylindrical air passages 14, each of which had a diameter of 0.196 inch (4.98 millimeters). The exhaust control buttons 15 were set so that each air passage 14 had an exhaust hole 0.0086 inch (0.218 millimeter) in diameter. The yarns collected during these runs were tested for strength using the feed yarn as the standard and were also visually examined to determine slub formation.

The results of these runs are shown in Table I.

Table 1

| Run | Yarn Designation* | Slubbed | Break Strength (Pounds) | Kilograms |
|---|---|---|---|---|
| 1 | DE-75 1/0 1.0Z | No | 3.34 | 1.5 |
| 2 | DE-37 1/0 1.0Z | No | 13.66 | 6.19 |
| 3 | DE-75 1/0 1.0Z (2 ends) | No | 14.02 | 6.35 |
| 4 | DE-37 1/0 1.0Z (2 ends) | No | 26.24 | 11.89 |
| 5 | DE-75 1/0 1.0Z | Yes | 3.88 | 1.75 |
| 6 | DE-37 1/0 1.0Z | Yes | 9.98 | 4.52 |
| 7 | DE-75 1/0 1.0Z (2 ends) | Yes | 10.67 | 4.83 |
| 8 | DE-37 1/0 1.0Z (2 ends) | Yes | 22.02 | 9.98 |

*The lettering DE refers to the filament diameter, the DE fiber having a diameter of .00025 inch (0.0063 millimeter). The number immediately following the letter designation times 100 equals the number of yards of yarn per pound of glass. The designation 1/0 indicates the number of ends utilized in the yarn, 1/0 being one end. The designation 1.0Z indicates one twist in the Z direction.

EXAMPLE II

In another run a glass strand was slubbed using a high speed winding system such as is shown in U.S. Pat. No. 2,730,137. The only modification of that system made was that the jets were removed and the size normally applied before winding was not applied. In that system a DE-75 glass strand was passed over a 3 inch (76.2 millimeter) diameter wheel surface. The surface of the wheel had 3/16 inch (4.76 millimeter) diameter holes drilled in it and vented to the atmosphere through the side wall of the wheel. Each vent hole on the wheel side wall was 1/16 inch (1.58 millimeter) in diameter. Air was fed to the surface of the strand as it passed over the wheel surface at 75 pounds per square inch gauge (517,106 pascal). The air was fed through a nozzle having the "dog bone" configuration of FIG. 18. The winder used wound the strand at 3,000 feet (914.4 meters) per minute. The strand was thus removed from a bobbin passed through an eyelet and conventional tensioning discs and over the wheel. The 3/16 inch (4.76 millimeter) holes on the wheel were spaced ⅜ inch (9.52 millimeters) from each other. The air was turned on at 75 pounds per square inch guage (517,050 pascal) and the strand wound on a standard Leesona winder at 3,000 feet (914.4 meters) per minute. The resulting spool of yarn had considerable texture and slubs formed along its length.

EXAMPLE III

Using the same equipment as Example II, a similar run was made with a DE-75 glass strand run from a bobbin source. This run was made at a winding speed of 1,100 feet (335.28 meters) per minute and using the air at 50 pounds per square inch gauge (344,737 pascal). Good slub formation was achieved and the strand appeared to have excellent strength.

EXAMPLE IV

The run of Example II was repeated with a DE-75 glass strand using a 3,000 feet (914.4 meter) per minute winding speed and 75 pounds per square inch gauge (517,106 pascal) air and an after size was applied to the strand after it passed over the wheel surface and before it was taken up by the winder in the manner shown in U.S. Pat. No. 3,370,137. The resulting strand contained slubs and texture and appeared to have excellent strength.

EXAMPLE V

A run similar to Example IV was made using a DE-75 glass strand with a size applied after the strand passed over the wheel and before it was collected. The winding speed was 1,100 feet (335.28 meters) per minute and the air pressure used was 50 pounds per square inch gauge (344,737 pascal). A good slub containing strand having good strength characteristics was produced.

EXAMPLE VI

In another operation, a wet forming package operation is simulated by applying moisture to a plurality of bobbins and utilizing wet bobbins as the source of supply of fiber glass yarn to the wheel surface 13. In this instance, the wet strands 3 and 4 are consolidated through an eyelet 9, passed through eyelet 10 and run on the concave surface of wheel 13 and across the air passages 14 associated therewith. High pressure air at 40 pounds per square inch gauge is fed onto the strand through jet inlet 12 as the strand passes over the wheel surface and the holes are adjusted at the vents of each of the gas passages 14 to provide a 3/16 inch (4.76 millimeters) diameter exit. Each of the holes 14 drilled in the wheel surface has a diameter of 3/16 inch (4.76 millimeters). The resulting yarn is wound at 1,340 linear feet (408.4 meters) per minute and contains slubs 16 positioned on the finished strand which characteristically are similar to that shown in FIG. 4, that is, the strand is twisted on either end of the slub and the slub is uniform and shaped as shown in FIG. 4 of the drawings.

EXAMPLE VII

In this example the apparatus illustrated in FIG. 6 was employed. DE-75 strand 41 was fed from a forming package 40 through a first set of nip rollers 42 and 43 at a linear speed of 1,300 feet (396.2 meters) per minute. The second set of nip rollers 46 and 47 was driven at 1,200 feet (363.8 meters) per minute, thus causing an overfeed to produce a low tension (approximately zero tension) loop of strand between the two sets of rollers. The low tension strand was passed over a solid wheel 44 as shown in FIG. 7 and air was supplied to the strand 41 from a "dog bone" shaped air jet 45 located above the wheel 44 at a distance of 0.125 inch (3.175 millimeters). Air was supplied to the strand 41 from the jet 45 at 50 pounds per square inch gauge (344,737 pascal). The resulting strand 48 was wound into a package by winder 49. The resulting strand had good slubs formed thereon and excellent strength.

EXAMPLE VIII

In this example the apparatus illustrated in FIG. 9 was employed. A slubbing tool 93 having an air jet 94, as such illustrated in FIG. 13, replaced the wheels of the previous examples. A low tension (approximately zero tension) loop was found in the strand of DE-75 glass fiber 91 employed by means of two low inertia capstans 92 and 95 connected by belt 96. Capstan 92 was driven at 1,200 feet (365.8 meters) per minute and capstan 95 at 1,300 feet (396.2 meters) per minute to form a loop of strand having apparently zero tension. This loop was fed through the slubbing tool 93 and air under pressure of 50 pounds per square inch gauge (344,737 pascal) was fed into the tool through air jet 94 having a "dog bone" shape. The air jet was located 0.156 inch (3.962 millimeters) above the working surface inside the slubbing tool 93. The resulting strand 95 having good slubs thereon and excellent strength was collected by winder 97.

EXAMPLE IX

The previous example was repeated with the substitution of a two-stage step godet for the low inertia capstans. This apparatus is shown in FIG. 10. The godet 72 was rotated to give step 73 a linear rate of speed of 1,300 feet (396.2 meters) per minute, and step 74 at a linear rate of speed of 1,200 feet (365.8 meters) per minute thus forming an approximately zero tension loop in strand 71. Air pressure was 45 pounds per square inch gauge (310,263 pascal), using the same slubbing tool as in the previous example. Good slubs were found on the resulting strand 77 and the strand had good strength.

EXAMPLE X

As illustrated in FIG. 8, a magnetic tensioning device 54 was employed in this example replacing the step godet of Example IX. Air pressure in the slubbing tool 51 was 50 pounds per square inch gauge (344,737 pascal) and the DE-75 glass strand 55 traveled at 600 feet (182.9 meters) per minute. Good slubs were produced on resulting strand 59, said strand having excellent strength.

Considerable versatility is provided by the instant process and apparatus in that strand effect can be changed considerably with small changes in the system. Thus, at lower speeds, 300 to 1,000 feet (91.44 to 304.8 meters) per minute and air pressures in the 30 to 75 pounds per square inch gauge (206,842 to 517,106 pascal), the slubs produced on a strand tend to be more clearly defined with little strand disturbance in between slubs. At similar air pressures and higher speeds, over 1,000 feet (304.8 meters) per minute, the effect on the strand is to provide for more texturing of the strand between slubs. While a wheel surface was employed in the examples, it is also feasible to use a stationary plate which may have appropriate air passages therein or a moving belt which may be provided with suitable apertures therein. Similarly, while steady air feeds are employed in the examples, it has been found that intermittent air flow can be used as a means to provide intermittent slub formation on a given length of strand with relative ease.

In general, the speed of strand travel can be varied between 200 and 5,000 feet (60.96 to 1,524 meters) per minute or more, with speeds of 300 to 3,000 feet (91.44 to 914.4 meters) per minute being those typically used. Air pressure, where air is used as the fluid, generally ranges between 20 to 80 pounds per square inch gauge (137,895 to 551,580 pascal), with pressures of 30 to 75 pounds per square inch gauge (206,842 to 517,106 pascal) being typical of those employed.

Where a wheel surface is employed as the working surface on which the fluid is forced through the strand to produce the slubby effect, the surface may move at the speed of the strand or slightly in excess thereof. The process will still operate with the surface in a stationary position.

The hole diameter and spacing of the holes when employed to fluff the strands on the working surface can be varied considerably to produce various effects. Thus, while a hole of 0.187 inch (4.76 millimeters) in diameter has been described in the above examples as desired in producing slubs on a glass strand, this can be varied considerably. Thus, holes ranging in diameter between 0.06 to 0.5 inch (1.524 to 12.7 millimeters) can be readily employed. In like fashion if desired, vent holes can be adjusted to sizes other than the 0.06 inch (1.524 millimeter) diameter employed in the examples.

While the invention has been described with reference to certain specific examples and illustrated embodiments, this is for discussion purposes only and is not to be construed as a limitation on the invention except insofar as appears in the accompanying claims.

We claim:

1. A method of providing a slubby strand of fibers comprising passing a consolidated strand containing a multiplicity of fibers over a surface, introducing onto the surface of the strand a fluid at high pressure continuously, twisting and bulking the strand with said fluid, and collecting from said surface a twisted strand having slubs thereon.

2. The method of claim 1 wherein said surface is formed on the periphery of a wheel and said wheel is rotating.

3. The method of claim 1 wherein the strand passing over the surface is varied in its rate of speed.

4. In a method of preparing a slubby glass yarn wherein a multiplicity of glass filaments are drawn from a molten glass source, coated with a suitable binder or size and consolidated into a strand, the improvement comprising passing the consolidated strand so formed over a surface, introducing high pressure fluid onto the surface of said strand continuously, twisting and bulking the strand with the fluid as the strand passes over the surface, rapidly passing the strand so twisted and bulked from said surface and collecting the twisted slubby strand thus produced.

5. The method of claim 4 wherein the surface is moving with said strand.

6. The method of claim 4 wherein the surface is formed on the periphery of a wheel and said wheel is rotating.

7. The method of claim 4 wherein the strand passing over the surface is varied in its rate of speed.

8. A method of preparing a consolidated glass strand characterized by having slubs placed on the surface thereof comprising drawing a consolidated glass fiber strand at a speed of 200 to 5,000 feet (60.96 to 1,524 meters) per minute across a surface, introducing a fluid onto the surface of said strand continuously as it is being drawn at a pressure of between 20 to 80 pounds per square inch gauge (137,895 to 551,580 pascal), twisting and bulking the strand with said fluid, rapidly removing the strand from said surface and collecting the resulting slubby strand.

9. The method of claim 8 wherein said fluid is air, said strand is drawn at speeds of 300 to 3,000 feet (91.44 to 914.4 meters) per minute and air pressure employed is between 30 to 75 pounds per square inch gauge (206,842 to 517,160 pascal).

10. The method of claim 8 wherein said fluid is fed to said surface intermittently.

11. The method of claim 8 wherein said fluid is fed continuously and the strand drawing speed is varied between said speeds during formation of said slubby strand.

* * * * *